US009431207B2

(12) United States Patent
Imai et al.

(10) Patent No.: US 9,431,207 B2
(45) Date of Patent: Aug. 30, 2016

(54) ROTATING-ANODE X-RAY TUBE ASSEMBLY AND ROTATING-ANODE X-RAY TUBE APPARATUS

(71) Applicant: Toshiba Electron Tubes & Devices Co., Ltd., Otawara-shi (JP)

(72) Inventors: Yoshifumi Imai, Otawara (JP); Tomonari Ishihara, Otawara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 137 days.

(21) Appl. No.: 14/488,489

(22) Filed: Sep. 17, 2014

(65) Prior Publication Data

US 2015/0078531 A1 Mar. 19, 2015

(30) Foreign Application Priority Data

Sep. 17, 2013 (JP) ..... 2013-191449

(51) Int. Cl.
*H01J 35/00* (2006.01)
*H01J 35/10* (2006.01)
*H01J 35/18* (2006.01)

(52) U.S. Cl.
CPC ..... *H01J 35/101* (2013.01); *H01J 35/106* (2013.01); *H01J 35/18* (2013.01)

(58) Field of Classification Search
CPC ..... H01J 35/00; H01J 35/02; H01J 35/065; H01J 35/08; H01J 35/10; H01J 35/101; H01J 35/105; H01J 35/106; H01J 35/16; H01J 35/165; H01J 35/18; H01J 2235/12; H01J 2235/1204; H01J 2235/1216; H01J 2235/1266; H05G 1/04; H05G 1/06
USPC ..... 378/122, 125, 130, 141, 142
See application file for complete search history.

(56) References Cited

FOREIGN PATENT DOCUMENTS

| | | |
|---|---|---|
| JP | 2000-243333 | 9/2000 |
| JP | 4836577 | 12/2011 |
| JP | 2013-175356 A | 9/2013 |

OTHER PUBLICATIONS

Office Action issued Mar. 16, 2016 in Korean Patent Application No. 10-2014-0116281 (with English language translation).

*Primary Examiner* — Jurie Yun
(74) *Attorney, Agent, or Firm* — Oblon, McClelland, Maier & Neustadt, L.L.P.

(57) ABSTRACT

According to one embodiment, a rotating-anode X-ray tube assembly includes an X-ray tube, a stator coil, a housing, an X-ray radiation window, and a coolant. The housing includes a first divisional part which includes an X-ray radiation port and to which the X-ray tube is directly or indirectly fixed, and a second divisional part located on a side opposite to an anode target with respect to an anode target rotating mechanism and coupled to the first divisional part. A coupling surface between the first divisional part and the second divisional part is located on one plane, and is inclined to an axis, with exclusion of a direction perpendicular to the axis.

13 Claims, 7 Drawing Sheets

ROTATING-ANODE X-RAY TUBE ASSEMBLY AND ROTATING-ANODE X-RAY TUBE APPARATUS

CROSS-REFERENCE TO RELATED APPLICATIONS

This application is based upon and claims the benefit of priority from Japanese Patent Application No. 2013-191449, filed Sep. 17, 2013, the entire contents of which are incorporated herein by reference.

FIELD

Embodiments described herein relate generally to a rotating-anode X-ray tube assembly and a rotating-anode X-ray tube apparatus.

BACKGROUND

In X-ray photography which is conducted in a medical field, etc., a rotating-anode X-ray tube assembly is generally used. The X-ray photography is, for instance, Roentgen photography, CT photography, etc. The rotating-anode X-ray tube assembly includes a housing, and a rotating-anode X-ray tube which is stored in the housing and radiates X-rays. A lead plate, which shields X-rays, is stuck to the inner surface of the housing. An X-ray radiation window, which passes X-rays radiated from the X-ray tube, is provided on the outer wall of the housing. A coolant, such as an insulation oil, is sealed in a space between the housing and the rotating-anode X-ray tube.

The rotating-anode X-ray tube includes an anode target, a cathode, and an envelope which accommodates the anode target and the cathode and has its inside reduced in pressure. The anode target can rotate at high speed (e.g. 10000 rpm). The anode target includes a target layer (umbrella-shaped portion) formed of a tungsten alloy. The cathode is located with eccentricity from the rotational axis of the anode target and is opposed to the target layer.

A high voltage is applied between the cathode and the anode target. Thus, if the cathode emits electrons, the electrons are accelerated and converged, and collide upon the target layer. Thereby, the target layer radiates X-rays, and the X-rays are discharged from the X-ray transmission window to the outside of the housing.

For example, the shape of a light-load X-ray tube assembly is substantially rotation-symmetric with respect to the axis of the X-ray tube. The housing is cylindrical, and includes a projection portion having a side surface to which a high-voltage receptacle is attached, an X-ray radiation window, and side plates which close both opening end portions of the cylindrical housing.

In the meantime, in recent years, in an X-ray tube assembly for CT photography use, etc., a housing including a first divisional part and a second divisional part has begun to be used in accordance with an increase in complexity of the shape of the X-ray tube, an increase in weight of the X-ray tube, and an increase in rotational speed of a rotating frame on which the X-ray tube assembly is mounted. The coupling surface between the first divisional part and second divisional part is parallel to the axis of the X-ray tube.

DETAILED DESCRIPTION

In general, according to one embodiment, there is provided a rotating-anode X-ray tube assembly comprising: an X-ray tube comprising an anode target including a target layer which emits X-rays, an anode target rotating mechanism configured to rotatably support the anode target, a cathode disposed opposite to the target layer in a direction along an axis of the anode target and configured to emit electrons, and an envelope accommodating the anode target, the anode target rotating mechanism and the cathode; a stator coil configured to generate a driving force for rotating the anode target rotating mechanism; a housing comprising an X-ray radiation port opening in a direction perpendicular to the axis, and storing and holding the X-ray tube and the stator coil; an X-ray radiation window configured to close the X-ray radiation port and to take out the X-rays to an outside of the housing; and a coolant filled in a space between the X-ray tube and the housing and absorbing at least part of heat produced by the X-ray tube. The housing includes a first divisional part which includes the X-ray radiation port and to which the X-ray tube is directly or indirectly fixed, and a second divisional part located on a side opposite to the anode target with respect to the anode target rotating mechanism and coupled to the first divisional part. A coupling surface between the first divisional part and the second divisional part is located on one plane, and is inclined to the axis, with exclusion of a direction perpendicular to the axis.

A rotating-anode X-tube assembly according to a first embodiment will be described hereinafter in detail with reference to the accompanying drawings. The rotating-anode X-ray tube assembly is used such that this assembly is fixed to, for example, a rotating frame of an X-ray CT scanner.

Figure 1:
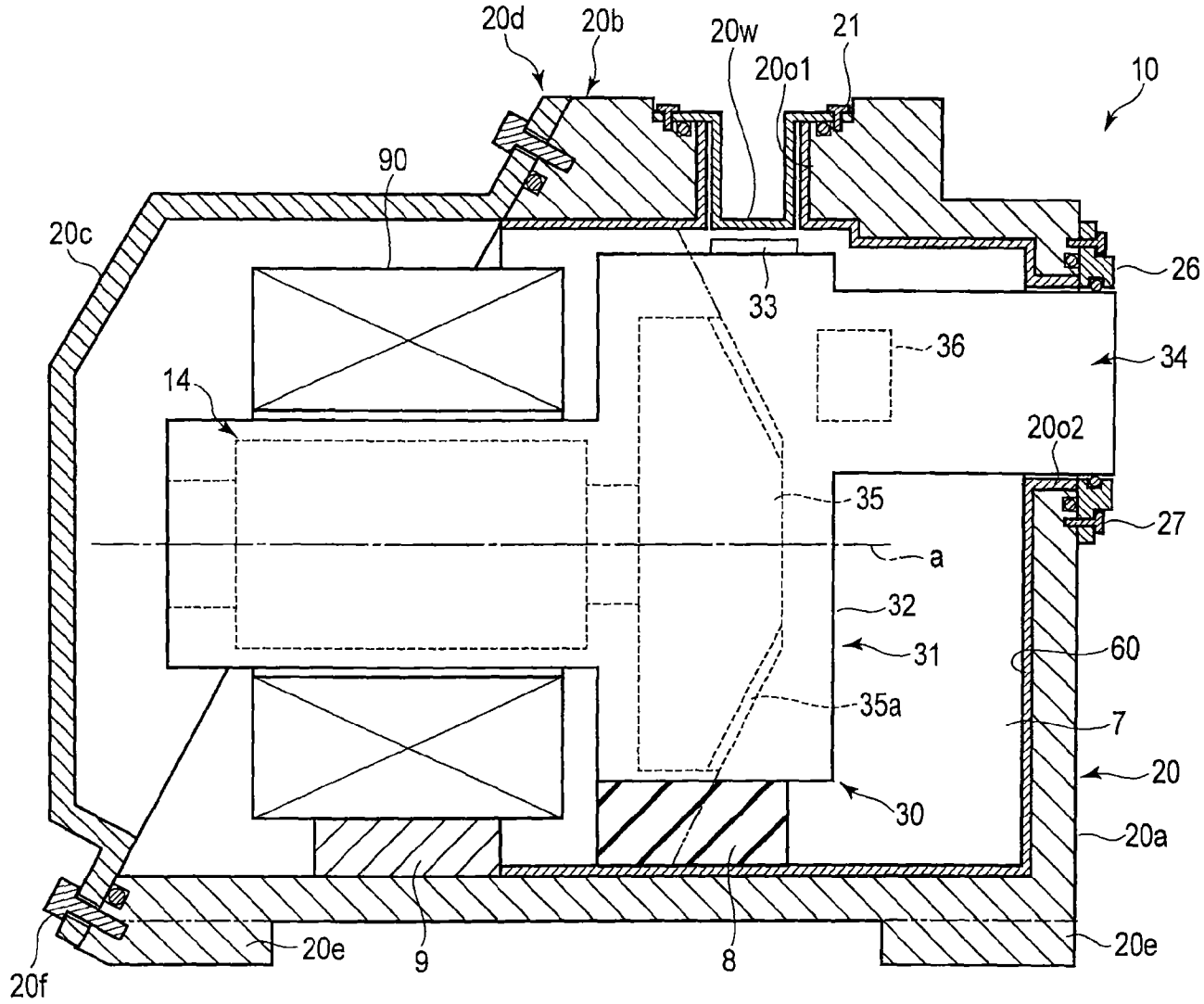
FIG. 1 is a cross-sectional view which illustrates a rotating-anode X-ray tube assembly according to a first embodiment, FIG. 1 illustrating an X-ray tube in side view.

As illustrated in FIG. 1, a rotating-anode X-ray tube assembly 10 includes a housing 20, an X-ray radiation window 20*w*, an X-ray tube 30 accommodated in the housing 20, a coolant 7 filled in the space between the X-ray tube 30 and housing 20, and a stator coil 90 functioning as a rotation drive module. In this case, the stator coil 90 generates a driving force for rotating an anode target rotating mechanism 14 (to be described later).

The housing 20 includes an X-ray radiation port 20*o*1 which is open in a direction perpendicular to an axis a of the X-ray tube 30, and a through-hole 20*o*2 extending in a direction along the axis a. The housing 20 stores and holds the X-ray tube 30 and stator coil 90.

The housing 20 includes a first divisional part 20*a* and a second divisional part 20*c*, which are divided. The housing 20 is formed of a metallic material or a resin material. In this embodiment, the first divisional part 20*a* and second divisional part 20*c* are formed of moldings using an aluminum alloy. Incidentally, the first divisional part 20*a* may be formed of an aluminum alloy molding (or resin material), and the second divisional part 20*c* may be formed of a resin material (or aluminum alloy molding).

The first divisional part 20*a* includes the X-ray radiation port 20*o*1 and through-hole 20*o*2. The X-ray tube 30 is directly or indirectly fixed to the first divisional part 20*a*. In this embodiment, an insulation member 8 and an X-ray shielding member 60 are interposed between the X-ray tube 30 and the first divisional part 20*a*, and the X-ray tube 30 is indirectly fixed to the first divisional part 20*a*.

The insulation member 8 is formed of a resin material or ceramics with high mechanical strength. The insulation member 8 prevents a positional displacement of the X-ray tube 30 in relation to the housing 20 in a direction perpendicular to the axis a. Furthermore, the insulation member 8 maintains electrical insulation between the X-ray tube 30 and the housing 20.

In addition, the stator coil 90 is directly or indirectly fixed to the first divisional part 20*a*. In this embodiment, a connection member 9 is interposed between the stator coil 90 and the first divisional part 20*a*, and the stator coil 90 is indirectly fixed to the first divisional part 20*a* via the connection member 9. Thus, the connection member 9 prevents a positional displacement of the stator coil 90 in relation to the housing 20 and X-ray tube 30. In addition, the connection member 9 is formed of a metal. Since the first divisional part 20*a* is set at a ground potential, the connection member 9 can also ground the stator coil 90.

The X-ray shielding member 60 is disposed along at least a part of the inner surface of the first divisional part 20*a*. In this embodiment, the X-ray shielding member 60 is stuck to at least a part of the inner surface of the first divisional part 20*a*. The X-ray shielding member 60 is formed of a material containing lead or a lead alloy as a main component.

The X-ray shielding member 60 is not provided in a region opposed to the connection member 9 and in a region on the second divisional part 20*c* side of the region opposed to the connection member 9. However, the X-ray shielding member 60 is provided with no gap in a region on the right side of the region opposed to the connection member 9 (i.e. the region opposed to the anode target 35, cathode 36, etc.). The X-ray shielding member 60 is also provided with no gap at a side edge of the X-ray radiation port 20*o*1 and at a side edge of the through-hole 20*o*2. Incidentally, the X-ray shielding member 60 is provided so as not to hinder the radiation of X-rays, which are used, to the outside of the housing 20 in the X-ray radiation port 20*o*1.

In addition, since the anode target 35 itself functions as an X-ray shielding member, the X-ray shielding member 60, together with the anode target 35, can prevent leakage of X-rays. Since the X-ray shielding member 60 (first divisional part 20*a*) extends in the direction along the axis a toward the second divisional part 20*c* side beyond an extension line of the surface of a target layer 35*a* (to be described later), the above-described advantageous effect can be obtained.

The second divisional part 20*c* is located on a side opposite to the anode target 35 with respect to the anode target rotating mechanism 14 (to be described later). The second divisional part 20*c* is coupled to the first divisional part 20*a*. In addition, the second divisional part 20*c* is formed so as not to affect the prevention of the above-described X-ray leakage. Specifically, the coupling surface between the first divisional part 20*a* and second divisional part 20*c* is located in a region where X-rays are shielded by the anode target 35.

Besides, the coupling surface is located on one plane, and is inclined to the axis a, with the exclusion of a direction perpendicular to the axis a. Thus, at one end face of the coupling surface, an angle formed relative to the axis a on the one hand is an acute angle, and an angle formed relative to the axis a on the other hand is an obtuse angle.

In this embodiment, in an attitude in which the axis a is parallel to a horizontal line, the X-ray radiation window 20*w* is located on the upper side of the anode target 35 and the cathode 36 is located on the right side of the anode target 35, the coupling surface is inclined in an upper-right direction. Thus, in this attitude, an upper-side one end face of the coupling surface forms an acute angle clockwise relative to the axis a, and forms an obtuse angle counterclockwise relative to the axis a.

By detaching the second divisional part 20*c* from the first divisional part 20*a*, the X-ray tube 30 and stator coil 90 can be exposed in a direction along the axis a and in a direction (upward) perpendicular to the axis a. Thus, the efficiency of manufacture of the rotating-anode X-ray tube assembly 10 can be enhanced. For example, after fixing the X-ray tube 30 to the first divisional part 20*a*, the stator 90 can be fixed to the first divisional part 20*a*.

Further, since the through-hole 20*o*2 is formed in the first divisional part 20*a*, and not in the second divisional part 20*c*, the first divisional part 20*a* and the second divisional part 20*c* can be coupled without requiring skill.

Moreover, since it is possible to suppress an interference during working between the X-ray tube 30 and stator coil 90, on the one hand, which are installed in the first divisional part 20*a*, and the second divisional part 20*c*, on the other hand, it becomes possible to suppress damage which is mutually suffered by at least one of the X-ray tube 30 and stator coil 90, and the second divisional part 20*c*.

Furthermore, after the X-ray tube 30 and stator coil 90 are installed in the first divisional part 20*a*, a gap between the X-ray tube 30 and stator coil 90 can be confirmed. Since the relative position between the X-ray tube 30 and stator coil 90 can be corrected where necessary, this can make it less likely that problems will arise with the rotational characteristics of the anode target rotating mechanism 14 of the X-ray tube 30 and the cooling capability of the X-ray tube 30.

The first divisional part 20*a* includes a frame portion 20*b* on the outer edge side of the opening. The second divisional part 20*c* includes a frame portion 20*d* on the outer edge side of the opening. In the frame portion 20*b*, a frame-shaped groove portion, which is formed on the side opposed to the frame portion 20*d*, is formed.

The first divisional portion 20*a* and second divisional portion 20*c* are touched such that the frame portions 20*b* and 20*d* are opposed, and the first divisional portion 20*a* and second divisional portion 20*c* are joined by a screw 20*f* serving as a fastening member. The gap between the frame portions 20*b* and 20*d* is liquid-tightly sealed by an O-ring which is provided in the above-described groove portion. The O-ring has a function of preventing leakage of the coolant 7 to the outside of the housing 20.

The inner surface of the housing 20 and the surface of the X-ray shielding member 60 are in contact with the coolant 7.

In this case, the rotating-anode X-ray tube assembly 10 includes a mounting portion 20*e*. The mounting portion 20*e* is formed so as to project from the outer surface of the first divisional part 20*a*. For example, the mounting portion 20*e* is directly or indirectly fixed to the rotating frame of an X-ray CT scanner.

The X-ray radiation window 20*w* is located in the outside of the housing 20. The X-ray radiation window 20*w* can be formed by using a material with high mechanical strength. In this embodiment, the X-ray radiation window 20*w* is formed by using aluminum, but can also be formed by using other metallic material such as beryllium, or a resin. Thus, the X-ray radiation window 20*w* can take out X-rays to the outside of the housing 20. The X-ray radiation window 20*w* has a concave shape, and is configured to reduce the distance between the X-ray tube 30 and the X-ray radiation window 20*w*.

The X-ray radiation window 20*w* includes an attachment region which is directly attached to the first divisional part 20*a*, and an X-ray transmission region. An attachment surface is formed on an outer wall of the first divisional part 20*a*, which is opposed to the X-ray radiation window 20*w*. The attachment surface is flat. A frame-shaped groove portion is formed in the attachment surface of the first divisional part 20*a* in a manner to surround the X-ray radiation port 20*o*1. An O-ring is disposed in the groove portion.

A screw 21 serving as a fastening member is passed through a through-hole formed in the attachment region of the X-ray radiation window 20*w*, and is fastened in a screw hole formed in the attachment surface of the first divisional part 20*a*. The screw hole formed in the first divisional part 20*a* forms, together with the screw 21, a pushing mechanism. Thereby, the position of the X-ray radiation window 20*w* relative to the first divisional part 20*a* (housing 20) can be fixed.

The O-ring is interposed between the first divisional part 20*a* and the X-ray radiation window 20*w*. The O-ring has a function of preventing leakage of the coolant 7 to the outside of the housing 20. Thus, the X-ray radiation window 20*w*, together with the O-ring, can liquid-tightly close the X-ray radiation port 20*o*1.

The X-ray tube 30 includes an envelope 31, an anode target 35, an anode target rotating mechanism 14, and a cathode 36. The envelope 31 accommodates the anode target 35, anode target rotating mechanism 14 and cathode 36.

The envelope 31 includes a container 32. The container 32 is formed of, for example, glass, or a metal such as copper, stainless steel or aluminum. An X-ray radiation window 33 is airtightly provided on the container 32. In this case, the X-ray radiation window 33 is formed of beryllium. A part of the envelope 31 is formed of a high-voltage insulation member.

In this embodiment, the envelope 31 (X-ray tube 30) includes a high-voltage connection part 34 which extends in the direction along the axis a, passes through the through-hole 20*o*2, and is exposed to the outside of the housing 20. The high-voltage connection part 34 is formed of a high-voltage insulation member and a high-voltage supply terminal. The high-voltage insulation member is formed of ceramics. The high-voltage supply terminal is a metallic terminal. The high-voltage supply terminal is provided so as to penetrate the high-voltage insulation member, has one end exposed to the outside of the housing 20 from the surface of the high-voltage insulation member (the high-voltage connection part 34), and has the other end electrically connected to the cathode 36.

The anode target 35 is provided within the envelope 31. The anode target 35 is formed in a disc shape. The anode target 35 includes a target layer 35*a* which is provided on a part of the outer surface of the anode target. Electrons radiated from the cathode 36 collide upon the target layer 35*a*, and thereby the target layer 35*a* emits X-rays. The anode target 35 is formed of a metal such as molybdenum or a molybdenum alloy. The target layer 35*a* is formed of a metal such as a tungsten alloy. The anode target 35 is rotatable.

The cathode 36 is provided within the envelope 31. The cathode 36 is disposed opposite to the target layer 35*a* in a direction along the axis a. The cathode 36 emits electrons which are radiated on the anode target 35. A relatively negative voltage is applied to the cathode 36 via the high-voltage supply terminal of the high-voltage connection part 34, and a filament current is supplied to a filament (electron emission source), not shown, of the cathode 36.

The anode target rotating mechanism 14 rotatably supports the anode target 35. The anode target rotating mechanism 14 includes a rotor, a bearing, a fixed body and a rotary body. The fixed body is formed in a columnar shape, and is fixed to the envelope 31. The fixed body rotatably supports the rotary body. The rotary body is formed in a cylindrical shape and is provided coaxial with the fixed body. The rotor is fixed to the outer surface of the rotary body. Incidentally, the rotor receives a driving force which is generated by the stator coil 90. The anode target 35 is fixed to the rotary body. The bearing is formed between the fixed body and the rotary body. The rotary body is provided so as to be rotatable together with the anode target 35.

In the meantime, the anode target 35 is grounded. For example, the anode target 35 is connected to a ground terminal (not shown) which is electrically insulatively provided on the housing 20, via the anode target rotating mechanism 14, a conductor line (not shown), etc.

The rotating-anode X-ray tube assembly 10 further includes a seal ring 26. The seal ring 26 is configured to liquid-tightly seal the coolant 7 coming through a gap between the through-hole 20*o*2 and the high-voltage connection part 34, and to prevent leakage of the coolant 7 to the outside of the housing 20.

The seal ring 26 is formed in a frame shape. The shape of the seal ring 26 is associated with the shape of the through-hole 20*o*2 and high-voltage connection part 34. In this case, the seal ring 26 is formed in an annular shape.

An annular groove portion is formed in an inner peripheral edge of the seal ring 26, which is opposed to the high-voltage connection part 34. A gap between the seal ring 26 and the high-voltage connection part 34 is sealed by an annular O-ring which is provided in the annular groove portion. The O-ring has a function of preventing leakage of the coolant 7 to the outside from the gap between the seal ring 26 and the high-voltage connection part 34.

A frame-shaped groove portion is formed in the outer surface of the first divisional part 20*a*, which surrounds the through-hole 20*o*2 and is opposed to the seal ring 26. An O-ring is disposed in the frame-shaped groove portion.

A screw 27 serving as a fastening member is passed through a through-hole formed in the seal ring 26, and is fastened in a screw hole formed in the first divisional part 20*a*. The screw hole formed in the first divisional part 20*a* forms, together with the screw 27, a pushing mechanism.

Thereby, the position of the seal ring 26 relative to the first divisional part 20*a* (housing 20) can be fixed.

The O-ring is interposed between the first divisional part 20*a* and the seal ring 26. The O-ring has a function of preventing leakage of the coolant 7 to the outside from the gap between the first divisional part 20*a* and the seal ring 26.

From the above, the seal ring 26, together with the O-ring and high-voltage connection part 34, can liquid-tightly close the through-hole 20*o*2.

The coolant 7 is filled in the space between the X-ray tube 30 and housing 20. The coolant 7 absorbs at least part of the heat produced by the X-ray tube 30. Incidentally, the coolant 7 also absorbs heat produced by the stator col 90, etc., other than the X-ray tube 30. As the coolant 7, an insulation oil or a water-based coolant can be used. In this embodiment, a water-based coolant is used as the coolant 7.

In the rotating-anode X-ray tube assembly 10 with the above-described structure, a predetermined current is applied to the stator coil 90, and thereby the rotor of the anode target rotating mechanism 14 rotates and the anode target 35 rotates. Next, a predetermined high voltage is applied between the anode target 35 and the cathode 36. In this case, the anode target 35 is grounded, and a negative high voltage and filament current are supplied to the cathode 36.

Thereby, an electron beam is radiated from the cathode 36 to the target layer 35*a* of the anode target 35, X-rays are radiated from the anode target 35, and the X-rays are radiated to the outside through the X-ray radiation window 33 and X-ray radiation window 20*w*.

According to the rotating-anode X-ray tube assembly 10 of the first embodiment with the above-described structure, the rotating-anode X-ray tube assembly 10 includes the rotating-anode X-ray tube 30, stator coil 90, housing 20, X-ray radiation window 20*w*, and coolant 7.

The housing 20 includes the first divisional part 20*a* and second divisional part 20*c*. The first divisional part 20*a* includes the X-ray radiation port 20*o*1, and the X-ray tube 30 is directly or indirectly fixed to the first divisional part 20*a*. The second divisional part 20*c* is located on the side opposite to the anode target 35 with respect to the anode target rotating mechanism 14, and is coupled to the first divisional part 20*a*. The coupling surface between the first divisional part 20*a* and second divisional part 20*c* is located on one plane, and is inclined to the axis a, with the exclusion of the direction perpendicular to the axis a.

After disposing only the X-ray tube 30 in the first divisional part 20*a*, the stator coil 90 can be disposed in the first divisional part 20*a*. The workability can be enhanced since there is no need to dispose the X-ray tube 30 and stator coil 90 as one body in the first divisional part 20*a* in the state in which the stator coil 90 is inserted over the X-ray tube 30. For example, a simple work can be made. Then, the stator coil 90 can be disposed with high precision.

The gap between the X-ray tube 30 and the stator coil 90 can be confirmed. Since the relative position between the X-ray tube 30 and stator coil 90 can be corrected where necessary, it becomes possible to avoid such a situation that problems will arise with the rotational characteristics of the anode target rotating mechanism 14 of the X-ray tube 30 and the cooling capability of the X-ray tube 30.

In addition, since there is no need to set a wide gap between the X-ray tube 30 and stator coil 90, it is possible to prevent degradation in the efficiency of rotary drive by a produced magnetic field of the stator coil 90, and to prevent an increase in power consumption of the stator coil 90.

The X-ray shielding member 60 (first divisional part 20*a*) extends in the direction along the axis a toward the second divisional part 20*c* side beyond the extension line of the surface of the target layer 35*a*. Specifically, the coupling surface between the first divisional part 20*a* and second divisional part 20*c* is located in a region where there is no fear of X-ray leakage. Thus, the X-ray shielding member 60, together with the anode target 35, can prevent leakage of X-rays.

In addition, since there is no need to adopt a special structure by providing an X-ray shielding member in the second divisional part 20*c* in a manner to overlap the X-ray shielding member 60, an increase in processing cost of the housing 20 can be suppressed.

Further, the first divisional part 20*a* includes the through-hole 20*o*2 extending in the direction along the axis a. The high-voltage connection part 34 extends in the direction along the axis a, passes through the through-hole 20*o*2, and is exposed to the outside of the housing 20. Since the through-hole 20*o*2 is formed in the first divisional part 20*a*, and not in the second divisional part 20*c*, the first divisional part 20*a* and the second divisional part 20*c* can be coupled without requiring skill.

Moreover, since it is possible to suppress an interference during working between the X-ray tube 30 and stator coil 90, on the one hand, which are installed in the first divisional part 20*a*, and the second divisional part 20*c*, on the other hand, this can make it less likely that damage is mutually suffered by at least one of the X-ray tube 30 and stator coil 90, and the second divisional part 20*c*.

From the above, the rotating-anode X-ray tube assembly 10 can be obtained which can prevent leakage of X-rays, has high product reliability, has a good manufacturing yield, and can suppress an increase in manufacturing cost and power consumption.

Next, a rotating-anode X-ray tube apparatus 1 according to a second embodiment will be described. In this embodiment, the same functional parts as in the above-described first embodiment are denoted by like reference numerals, and a detailed description thereof is omitted. The rotating-anode X-ray tube apparatus 1 is used such that this apparatus 1 is fixed to, for example, a rotating frame of an X-ray CT scanner.

Figure 2:
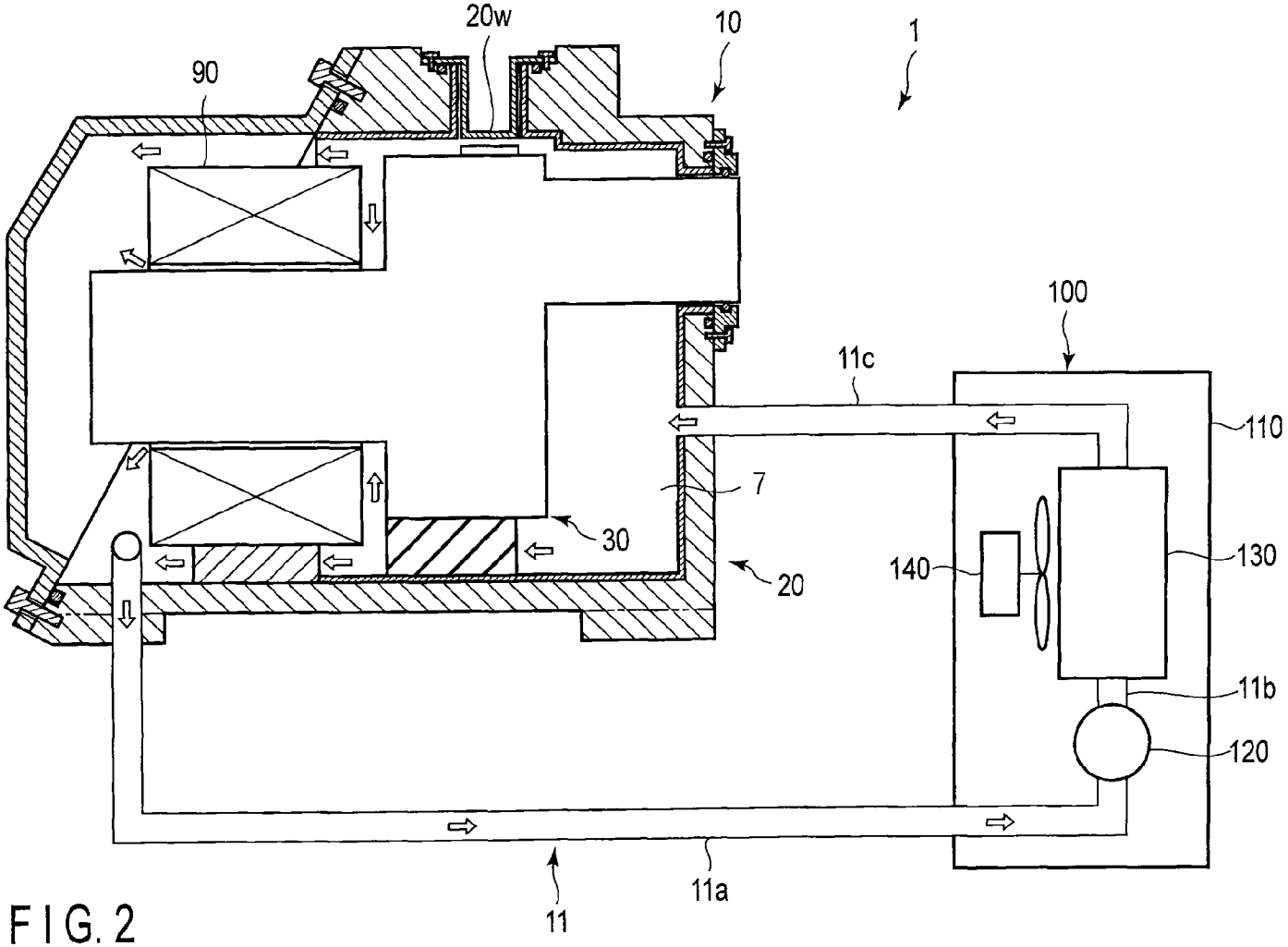
FIG. 2 is a cross-sectional view which illustrates a rotating-anode X-ray tube apparatus according to a second embodiment, FIG. 2 illustrating an X-ray tube in side view and illustrating a cooler unit in block diagram.

As illustrated in FIG. 2, the rotating-anode X-ray tube apparatus 1 includes the rotating-anode X-ray tube assembly 10 according to the first embodiment. The rotating-anode X-ray tube apparatus 1 further includes a conduit 11 and a cooler unit 100. The conduit 11 is made to communicate with the housing 20, and forms, together with the housing 20, a passage of the coolant 7. The cooler unit 100 includes a casing 110, a circulating pump 120 which is accommodated in the casing 110, a radiator 130, and a fan unit 140 serving as an air feed module. The circulating pump 120 is attached to the conduit 11, and circulates the coolant 7. The radiator 130 is attached to the conduit 11, and radiates heat of the coolant 7. The fan unit 140 produces a flow of air in the vicinity of the radiator 130. The radiator 130 and fan unit 140 constitute a heart exchanger.

The conduit 11 includes a first conduit 11*a*, a second conduit 11*b* and a third conduit 11*c*. The first conduit 11*a* has one end portion connected liquid-tightly to an opening of the first divisional part 20*a*, and has the other end portion connected liquid-tightly to an intake port of the circulating pump 120. The second conduit 11*b* has one end portion connected liquid-tightly to a discharge port of the circulating pump 120, and has the other end connected liquid-tightly to the radiator 130. The third conduit 11*c* has one end portion connected liquid-tightly to the radiator 130, and has the other end connected liquid-tightly to the other opening of the first divisional part 20*a*.

According to the rotating-anode X-ray tube apparatus 1 of the second embodiment with the above-described structure, the rotating-anode X-ray tube apparatus 1 includes the rotating-anode X-ray tube assembly 10. The rotating-anode X-ray tube assembly 10 includes the rotating-anode X-ray tube 30, stator coil 90, housing 20, X-ray radiation window 20*w*, and coolant 7. Thus, the same advantageous effects as in the above-described first embodiment can be obtained.

The rotating-anode X-ray tube apparatus 1 includes the circulating pump 120. Since forced convection can be caused to occur in the coolant 7 in the housing 20, the temperature distribution of the coolant 7 in the housing 20 can be made uniform.

The rotating-anode X-ray tube apparatus 1 includes the radiator 130 and fan unit 140. Thus, the radiation to the outside of the heat produced by the X-ray tube 30, etc. can be further promoted.

From the above, the rotating-anode X-ray tube assembly 10 and rotating-anode X-ray tube apparatus 1 can be obtained which can prevent leakage of X-rays, has high product reliability, has a good manufacturing yield, and can suppress an increase in manufacturing cost and power consumption.

Next, a modification of the rotating-anode X-ray tube apparatus 1 according to the second embodiment will be described. Incidentally, in this modification, too, the same advantageous effects as in the second embodiment can be obtained.

Figure 3:
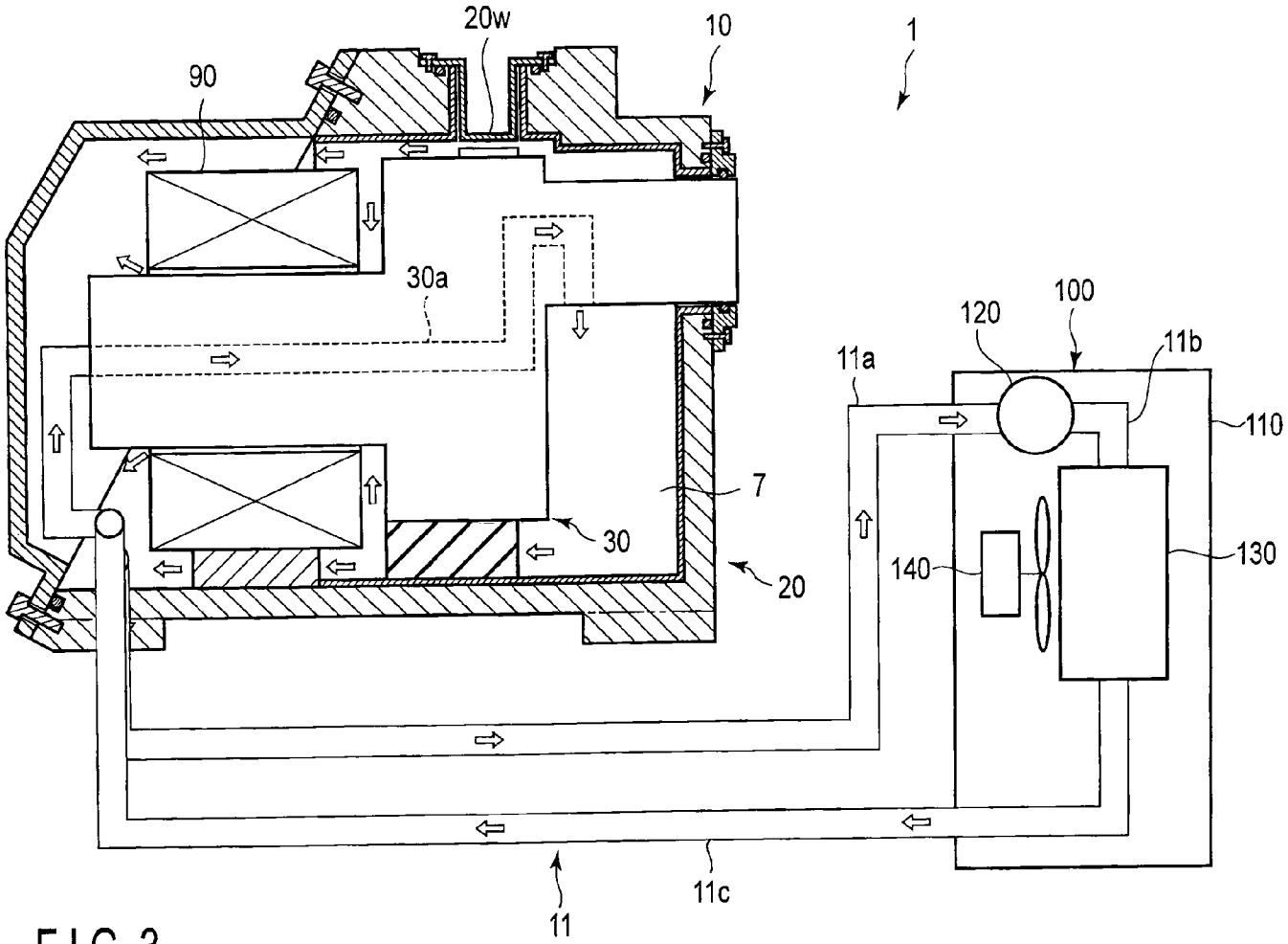
FIG. 3 is a cross-sectional view which illustrates a modification of the rotating-anode X-ray tube apparatus according to the second embodiment, FIG. 3 illustrating an X-ray tube in side view and illustrating a cooler unit in block diagram.

As illustrated in FIG. 3, the X-ray tube 30 may include a cooling passage 30*a* which radiates at least part of the heat which is produced by the X-ray tube 30 itself. The cooling passage 30*a* includes an intake port for taking in the coolant 7, and a discharge port for discharging the coolant 7. In this case, the conduit 11 can be directly attached to the intake port of the cooling passage 30*a*. Since forced convection can be caused to occur in the coolant 7 in the cooling passage 30*a*, the X-ray tube 30 can further be cooled.

In the meantime, in this example, the third conduit 11*c* is liquid-tightly attached to the other opening of the first divisional part 20*a*, and the other end portion of the third conduit 11*c* is directly attached to the intake port of the cooling passage 30*a*. Thereby, the coolant 7, which has been cooled through the radiator 130, can be introduced into the cooling passage 30*a*.

Next, another modification of the rotating-anode X-ray tube apparatus 1 according to the second embodiment will be described. Incidentally, in this another modification, too, the same advantageous effects as in the second embodiment can be obtained.

Figure 4:
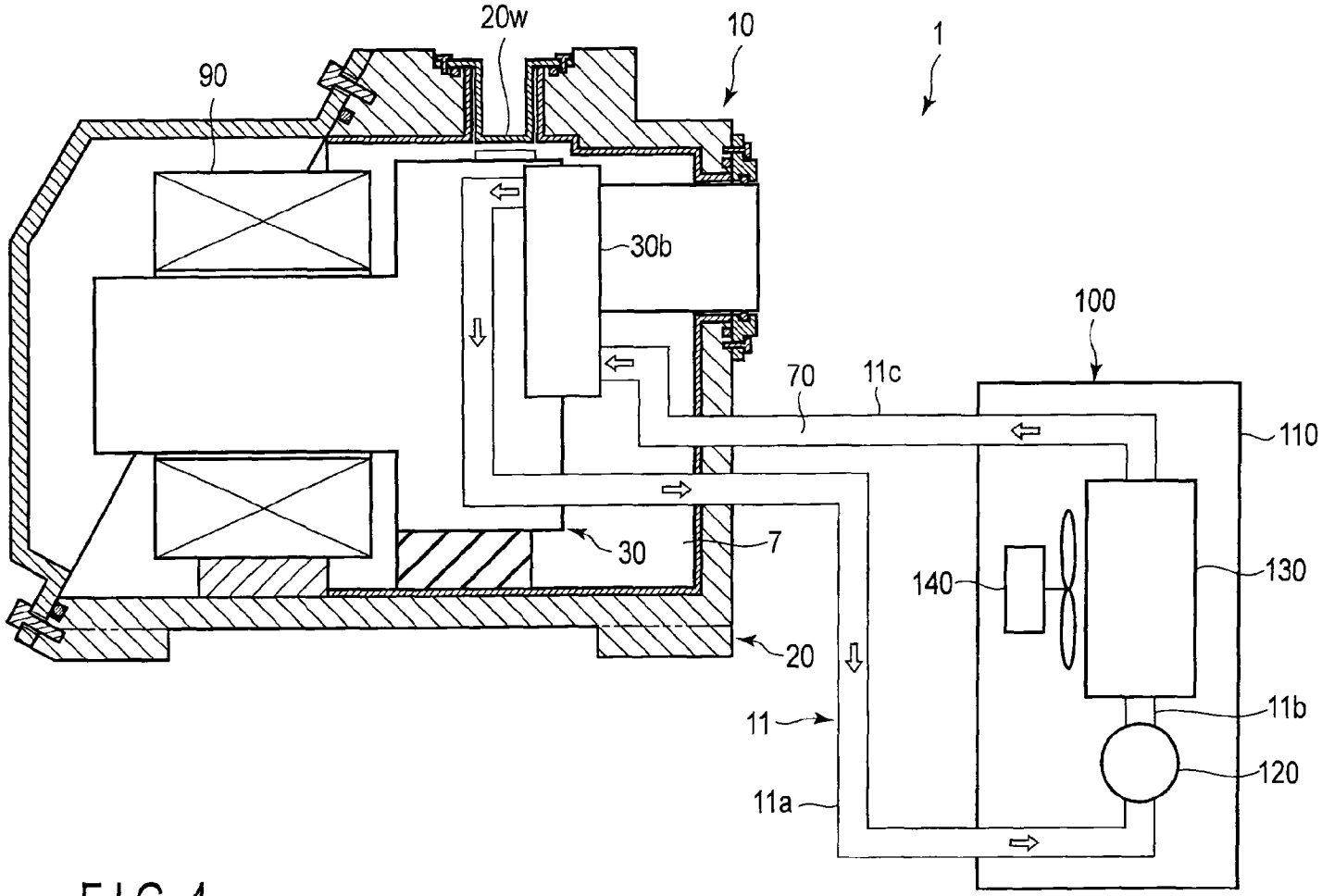
FIG. 4 is a cross-sectional view which illustrates another modification of the rotating-anode X-ray tube apparatus according to the second embodiment, FIG. 4 illustrating an X-ray tube in side view and illustrating a cooler unit in block diagram.

As illustrated in FIG. 4, the X-ray tube 30 may include a cooling passage 30*b* which radiates at least part of the heat which is produced by the X-ray tube 30 itself. The cooling passage 30*b* includes an intake port for taking in a cooling (another coolant) 70, and a discharge port for discharging the coolant 70. In this case, the conduit 11 can be directly attached to both the intake port and the discharge port of the cooling passage 30*b*. Since the coolant 7 and coolant 70 can be used together and forced convection can be caused to occur in the coolant 70 in the cooing passage 30*b*, the X-ray tube 30 can further be cooled.

In this example, an insulation oil is used as the coolant 7, and a water-based coolant is used as the coolant 70. The coolant 70 is filled in the cooling passage 30*b* and conduit 11, and absorbs at least part of the heat produced by the X-ray tube 30.

The conduit 11 is made to communicate with the cooling passage 30*b* of the X-ray tube 30 through the housing 20. To be more specific, one end portion of the first conduit 11*a* is made to communicate with the discharge port of the cooling passage 30*b*, and the other end portion of the third conduit 11*c* is made to communicate with the intake port of the cooling passage 30*b*. The circulating pump 120 circulates the coolant 70. The radiator 130 radiates the heat of the coolant 70.

Next, a rotating-anode X-ray tube assembly according to a third embodiment will be described. In this embodiment, the same functional parts as in the above-described first embodiment are denoted by like reference numerals, and a detailed description thereof is omitted.

Figure 5:
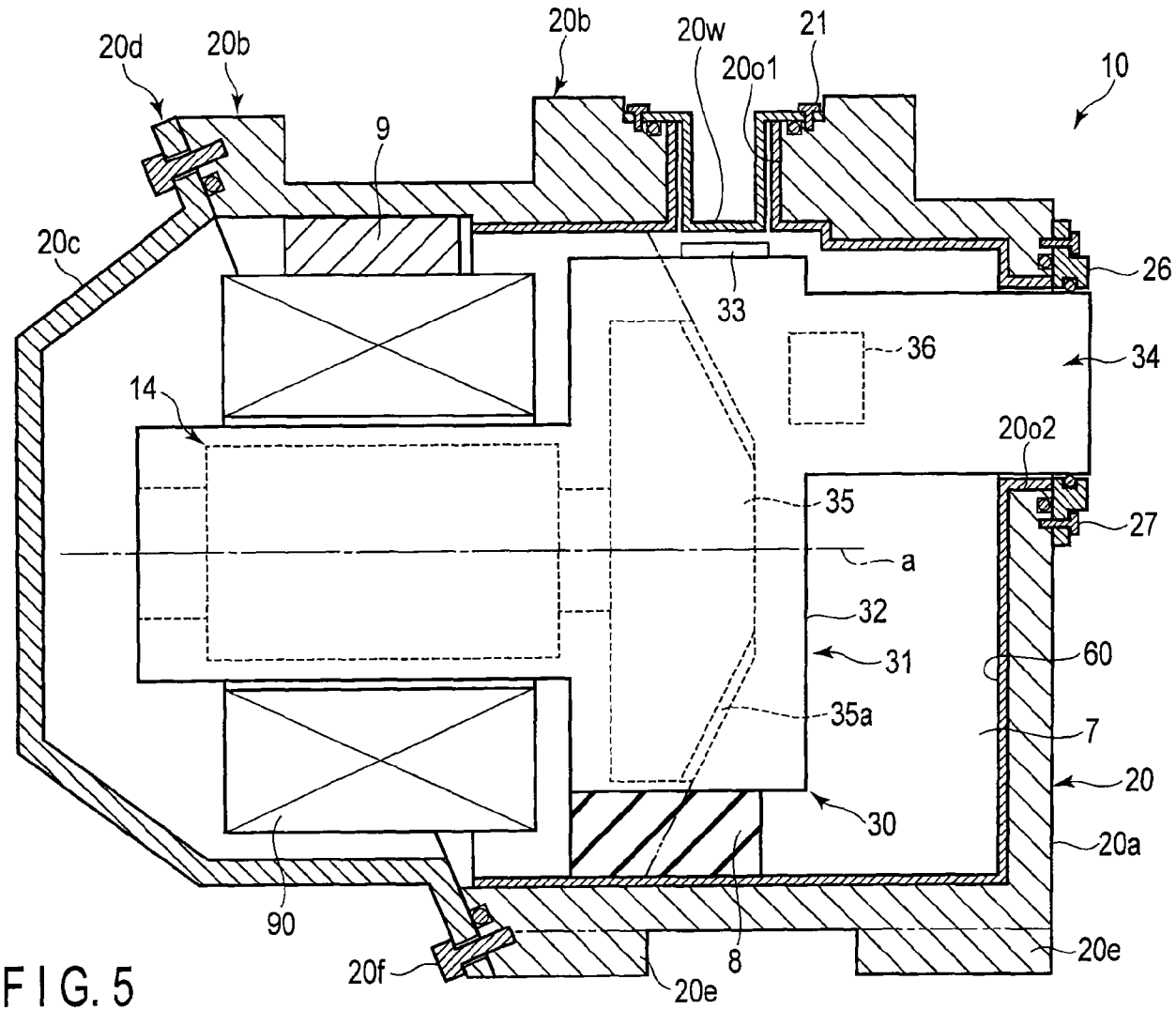
FIG. 5 is a cross-sectional view which illustrates a rotating-anode X-ray tube assembly according to a third embodiment, FIG. 5 illustrating an X-ray tube in side view.

As illustrated in FIG. 5, the coupling surface between the first divisional part 20*a* and second divisional part 20*c* is located on one plane, and is inclined to the axis a on a side opposite to the case of the first and second embodiments. In this embodiment, in an attitude in which the axis a is parallel to the horizontal line, the X-ray radiation window 20*w* is located on the upper side of the anode target 35 and the cathode 36 is located on the right side of the anode target 35, the coupling surface is inclined in a lower-right direction.

The second divisional part 20*c* is formed so as not to affect the prevention of X-ray leakage. Specifically, the coupling surface between the first divisional part 20*a* and second divisional part 20*c* is located in a region where X-rays are shielded by the anode target 35.

The X-ray shielding member 60 (first divisional part 20*a*) extends in the direction along the axis a toward the second divisional part 20*c* side beyond an extension line of the surface of the target layer 35*a*. Thus, the X-ray shielding member 60, together with the anode target 35, can prevent leakage of X-rays.

By detaching the second divisional part 20*c* from the first divisional part 20*a*, the X-ray tube 30 and stator coil 90 can be exposed in a direction along the axis a and in a direction (downward) perpendicular to the axis a. Thus, the efficiency of manufacture of the rotating-anode X-ray tube assembly 10 can be enhanced. For example, after fixing the X-ray tube 30 to the first divisional part 20*a*, the stator 90 can be fixed to the first divisional part 20*a*. Incidentally, by varying the attitude of the first divisional part 20*a* where necessary, it becomes possible to make it easier to fix the X-ray tube 30 and stator coil 90 to the first divisional part 20*a*.

In addition, in this embodiment, too, the mounting portion 20*e* is formed on the first divisional part 20*a*. In this case, two mounting portions 20*e* are formed on the first divisional part 20*a* with an interval in the direction along the axis a.

According to the rotating-anode X-ray tube assembly 10 of the third embodiment with the above-described structure, the rotating-anode X-ray tube assembly 10 includes the rotating-anode X-ray tube 30, stator coil 90, housing 20, X-ray radiation window 20*w*, and coolant 7.

The housing 20 includes the first divisional part 20*a* and second divisional part 20*c*. The first divisional part 20*a* includes the X-ray radiation port 20*o*1, and the X-ray tube 30 is directly or indirectly fixed to the first divisional part 20*a*. The second divisional part 20*c* is located on the side opposite to the anode target 35 with respect to the anode target rotating mechanism 14, and is coupled to the first divisional part 20*a*. The coupling surface between the first divisional part 20*a* and second divisional part 20*c* is located on one plane, and is inclined to the axis a, with the exclusion of the direction perpendicular to the axis a.

The coupling surface between the first divisional part 20*a* and second divisional part 20*c* is inclined in a lower-right direction. In this case, too, the same advantageous effects as in the above-described first embodiment can be obtained.

From the above, the rotating-anode X-ray tube assembly 10 can be obtained which can prevent leakage of X-rays, has high product reliability, has a good manufacturing yield, and can suppress an increase in manufacturing cost and power consumption.

Next, a rotating-anode X-ray tube assembly according to Comparative Example 1 will be described.

Figure 6:
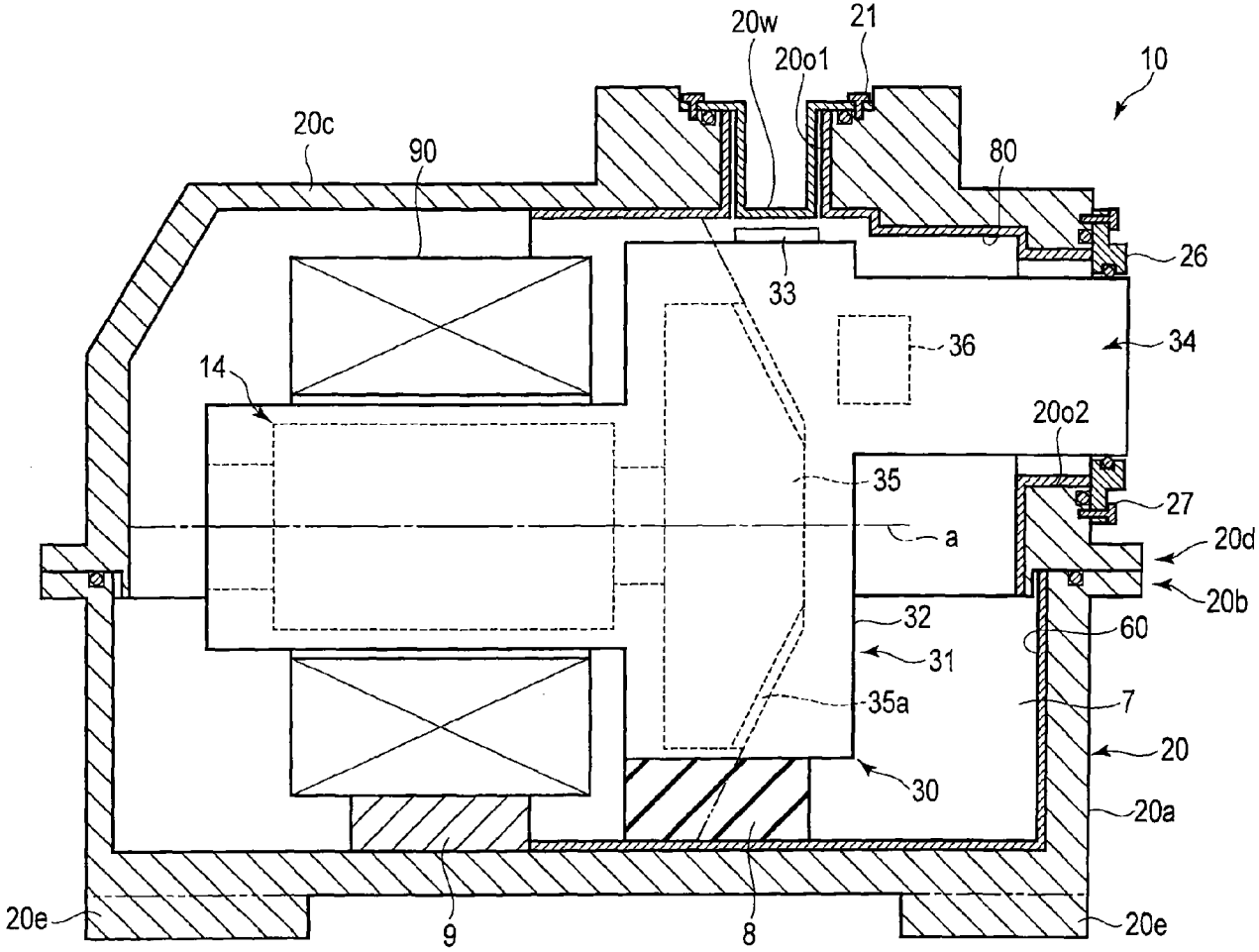
FIG. 6 is a cross-sectional view which illustrates a rotating-anode X-ray tube assembly according to Comparative Example 1, FIG. 6 illustrating an X-ray tube in side view.

As illustrated in FIG. 6, the rotating-anode X-ray tube assembly 10 is, in general terms, an anode-grounding-type X-ray tube assembly constructed like the rotating-anode X-ray tube assembly according to the above-described first embodiment. However, the coupling surface between the first divisional part 20*a* and second divisional part 20*c* is parallel to the axis a of the X-ray tube 30.

Thus, such a special structure is adopted that an X-ray shielding member 60 is provided on the first divisional part 20*a,* an X-ray shielding member 80 is provided on the second divisional part 20*c,* and the X-ray shielding member 60 and X-ray shielding member 80 oppose each other. The reason for this is that it is highly possible that X-rays leak from the coupling surface of the housing 20. In the case of Comparative Example 1, however, an increase in processing cost of the housing 20 will occur. The second divisional part 20*c* includes the X-ray radiation port 20*o*1 and through-hole 20*o*2. The X-ray radiation window 20*w* is attached to the second divisional part 20*c,* and closes the X-ray radiation port 20*o*1.

According to the rotating anode X-ray tube assembly 10 of the comparative example 1 with the above-described structure, the stator coil 90 cannot be disposed in the first divisional part 20*a,* after disposing only the X-ray tube 30 in the first divisional part 20*a*. It is necessary to dispose the X-ray tube 30 and stator coil 90 as one body in the first divisional part 20*a* in the state in which the stator coil 90 is inserted over the X-ray tube 30.

The gap between the X-ray tube 30 and the stator coil 90 cannot be confirmed. Since it is difficult to correct the relative position between the X-ray tube 30 and stator coil 90, problems may arise with the rotational characteristics of the anode target rotating mechanism 14 of the X-ray tube 30 and the cooling capability of the X-ray tube 30.

In addition, there may be a need to set a wide gap between the X-ray tube 30 and stator coil 90. This may lead to degradation in the efficiency of rotary drive by a produced magnetic field of the stator coil 90, and to an increase in power consumption of the stator coil 90.

Further, since the through-hole 20*o*2 is formed in the second divisional part 20*c,* skill is required to couple the first divisional part 20*a* and the second divisional part 20*c*.

Moreover, it is possible that the X-ray tube 30 and stator coil 90, on the one hand, which are installed in the first divisional part 20*a,* and the second divisional part 20*c,* on the other hand, interfere during working, and are mutually damaged. After the assembling in the housing, it is not possible to confirm whether the X-ray tube, stator coil, second divisional part, etc. have been damaged. Thus, there is concern that a problem will arise in a subsequent manufacturing process or during the use by the user.

Next, a rotating-anode X-ray tube assembly according to Comparative Example 2 will be described.

Figure 7:
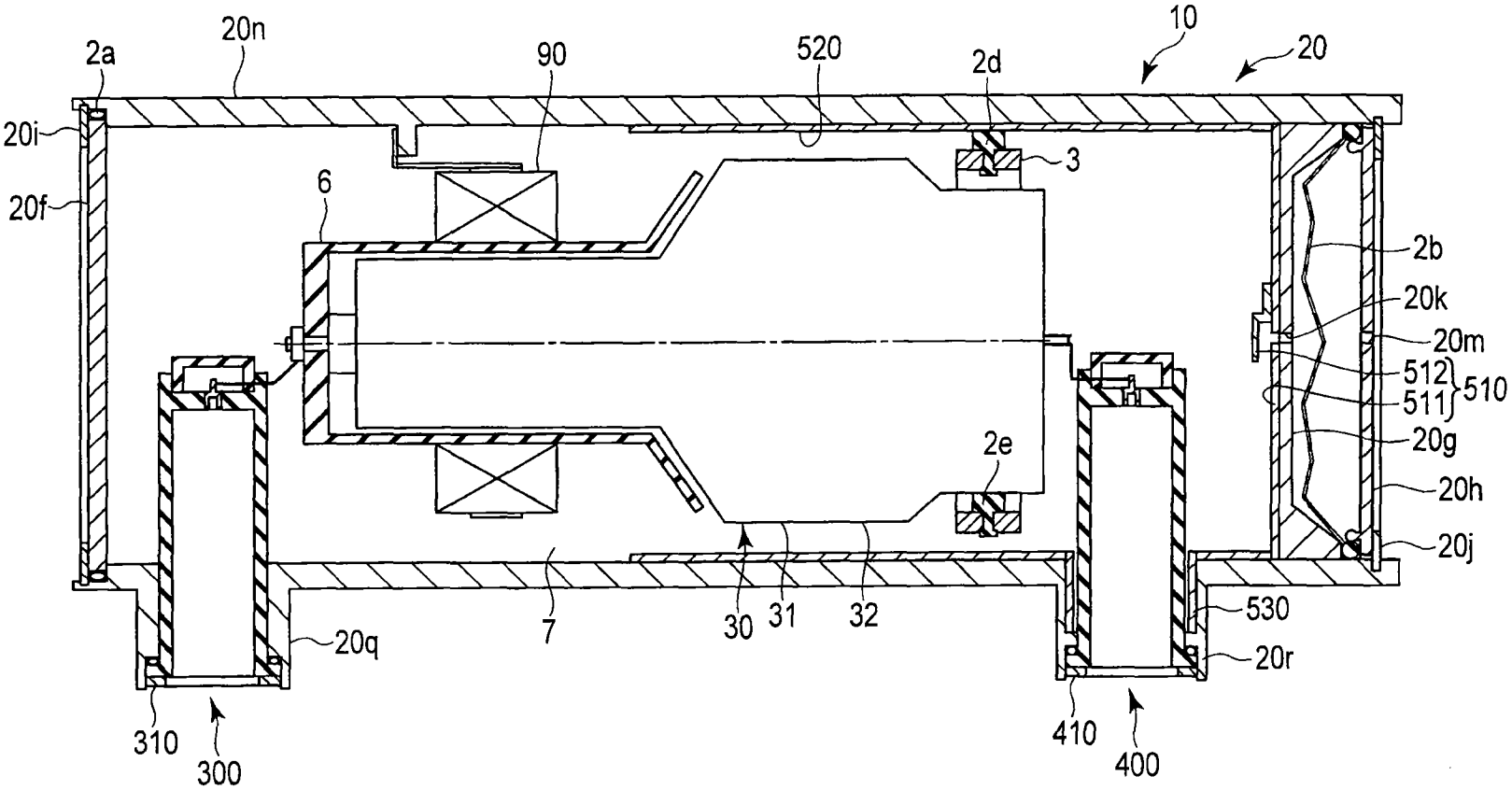
FIG. 7 is a cross-sectional view which illustrates a rotating-anode X-ray tube assembly according to Comparative Example 2, FIG. 7 illustrating an X-ray tube in side view.

As illustrated in FIG. 7, the shape of the rotating-anode X-ray tube assembly 10 is substantially rotation-symmetric with respect to the axis of the X-ray tube 30. The housing 20 is cylindrical and includes, on its side, a projection portion to which a high-voltage receptacle is attached, and an X-ray radiation port.

The structure of the rotating-anode X-ray tube assembly 10 of Comparative Example 2 is described below.

The rotating-anode X-ray tube assembly 10 is, in general terms, a neutral-grounding-type X-ray tube assembly including the housing 20, X-ray tube 30, coolant 7 (insulation oil), high-voltage insulation member 6, stator coil 90, and receptacles 300, 400.

The housing 20 includes a cylindrically formed housing body 20*n,* and cover parts (side plates) 20*f,* 20*g,* 20*h*. In a direction along the axis a of the X-ray tube 30, a peripheral edge portion of the cover part 20*f* is in contact with a stepped portion of the housing body 20*n*. A rubber member 2*a* is formed of an O-ring and is provided between the housing body 20*n* and the cover part 20*f*. A C type retaining ring 20*i* is fitted in the groove portion of the housing body 20*n*.

In the direction along the axis a of the X-ray tube 30, a peripheral edge portion of the cover part 20*g* is in contact with a stepped portion of the housing body 20*n*. The cover part 20*g* includes an opening portion 20*k* through which the coolant 7 comes in and goes out. A vent hole 20*m,* through which air as an atmosphere comes in and goes out, is formed in the cover part 20*h*. A C type retaining ring 20*j* is fitted in a groove portion of the housing body 20*n*. A seal portion of a rubber member 2*b* is formed like an O-ring.

A fixed shaft of the X-ray tube 30 is fixed to the container 32 and high-voltage insulation member 6. The high-voltage insulation member 6 is directly fixed to the housing 20, or indirectly fixed to the housing 20 via the stator coil 90. The high-voltage insulation member 6 is configured to effect electrical insulation between the fixed shaft (X-ray tube 30), and the housing 20 and stator coil 90.

The rotating-anode X-ray tube assembly 10 further includes X-ray shielding members 510, 520 and 530.

The X-ray shielding member 510 is provided on one side of the housing 20 and shields X-rays which are radiated from the target layer 35*a*. The X-ray shielding member 510 includes a first shielding portion 511 and a second shielding portion 512.

The X-ray shielding member 520 is formed in a cylindrical shape. One end portion of the X-ray shielding member 520 is close to the first shielding portion 511. The X-ray shielding member 530 is formed in a cylindrical shape and is provided in a cylindrical portion 20*r* of the housing 20. One end portion of the X-ray shielding member 530 is close to the X-ray shielding member 520.

A holding member 3 and rubber members 2*d,* 2*e* are provided between the X-ray tube 30 and the housing 20. The stator coil 90 is fixed to the housing body 20*n*. The receptacle 300 for the anode is located inside a cylindrical portion 20*q* of the housing 20 and is attached to the cylindrical portion 20*q*. A ring nut 310 is fastened to a stepped portion of the cylindrical portion 20*q* and pushes the receptacle 300. The receptacle 400 for the cathode is located inside the cylindrical portion 20*r* of the housing 20 and is attached to the cylindrical portion 20*r*. A ring nut 410 is fastened to a stepped portion of the cylindrical portion 20*r* and pushes the receptacle 400.

According to the rotating-anode X-ray tube assembly 10 of the comparative example with the above-described structure, the end portion of the anode of the X-ray tube can relatively easily be fixed to the high-voltage insulation member 6 which is attached to the cylindrical housing 20. However, the cathode side of the X-ray tube is merely elastically supported and fixed to the cylindrical housing 20 via the holding member 3 and rubber members 2*d*, 2*e*.

In the meantime, in recent years, in an X-ray tube assembly for CT photography use, etc., with an increase in complexity of the shape of the X-ray tube 30, an increase in weight of the X-ray tube 30, and an increase in rotational speed of a rotating frame to which the X-ray tube assembly is mounted, there may be a case which cannot be coped with by the fixing structure of the X-ray tube to the housing in the above-described comparative example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the above embodiments, the X-ray shielding member 60 is stuck to only the inner surface of the first divisional part 20*a*, but the embodiments are not limited to this example. The X-ray shielding member may be stuck to the inner surface of the second divisional part 20*c*. In this case, it is possible to contribute to further reduction in the amount of leakage of scattered X-rays.

The X-ray shielding member (60) does not need to be stuck to the inner surface of the housing 20, and may be disposed within the housing 20 while being spaced apart from the inner surface of the housing 20.

It is desirable that the entire surface of the X-ray shielding member (60) be coated with an organic coating film. The reason for this is that, for example, when the coolant 7 is a water-based coolant, if the X-ray shielding member is in a state of immersion in the water-based coolant, such problems will arise that the lead, of which the X-ray shielding member is formed, is gradually corroded and dissolved during use and the electrical conductivity of the coolant 7 increases, or that a deposit containing lead as a main component forms on a metallic outer surface of the X-ray tube 30.

The embodiments of the invention are applicable not only to the above-described rotating-anode X-ray tube assembly 10 and rotating-anode X-ray tube apparatus 1, but also to various kinds of rotating-anode X-ray tube assemblies and rotating-anode X-ray tube apparatuses. For example, the rotating-anode X-ray tube assembly is not limited to a rotating-anode X-ray tube assembly of an anode-grounding type, but may be a rotating-anode X-ray tube assembly of a cathode-grounding type or a rotating-anode X-ray tube assembly of a neutral-grounding type.

What is claimed is:

1. A rotating-anode X-ray tube assembly comprising:

an X-ray tube comprising an anode target including a target layer which emits X-rays, an anode target rotating mechanism configured to rotatably support the anode target, a cathode disposed opposite to the target layer in a direction along an axis of the anode target and configured to emit electrons, and an envelope accommodating the anode target, the anode target rotating mechanism and the cathode;

a stator coil configured to generate a driving force for rotating the anode target rotating mechanism;

a housing comprising an X-ray radiation port opening in a direction perpendicular to the axis, and storing and holding the X-ray tube and the stator coil;

an X-ray radiation window configured to close the X-ray radiation port and to take out the X-rays to an outside of the housing; and a coolant filled in a space between the X-ray tube and the housing and absorbing at least part of heat produced by the X-ray tube, wherein the housing includes a first divisional part which includes the X-ray radiation port and to which the X-ray tube is directly or indirectly fixed, and a second divisional part located on a side opposite to the anode target with respect to the anode target rotating mechanism and coupled to the first divisional part, and a coupling surface between the first divisional part and the second divisional part is located on one plane, and is inclined to the axis, with exclusion of a direction perpendicular to the axis.

2. The rotating-anode X-ray tube assembly of claim 1, further comprising an X-ray shielding member disposed along at least a part of an inner surface of the first divisional part.

3. The rotating-anode X-ray tube assembly of claim 2, wherein the X-ray shielding member is stuck to at least a part of the inner surface of the first divisional part.

4. The rotating-anode X-ray tube assembly of claim 2, wherein the X-ray shielding member is formed of a material containing lead or a lead alloy as a main component.

5. The rotating-anode X-ray tube assembly of claim 2, wherein the first divisional part and the X-ray shielding member extend in the direction along the axis toward the second divisional part side beyond an extension line of a surface of the target layer.

6. The rotating-anode X-ray tube assembly of claim 1, wherein the coupling surface is inclined in an upper-right direction, in an attitude in which the axis is parallel to a horizontal line, the X-ray radiation window is located on an upper side of the anode target and the cathode is located on a right side of the anode target.

7. The rotating-anode X-ray tube assembly of claim 1, wherein the stator coil is directly or indirectly fixed to the first divisional part.

8. The rotating-anode X-ray tube assembly of claim 1, wherein the anode target is grounded, and a negative high voltage is applied to the cathode.

9. The rotating-anode X-ray tube assembly of claim 1, wherein the first divisional part includes a through-hole extending in the direction along the axis, and the X-ray tube includes a high-voltage connection part which extends in the direction along the axis, passes through the through-hole, and is exposed to an outside of the housing.

10. A rotating-anode X-ray tube apparatus comprising:

an X-ray tube comprising an anode target including a target layer which emits X-rays, an anode target rotating mechanism configured to rotatably support the anode target, a cathode disposed opposite to the target layer in a direction along an axis of the anode target and configured to emit electrons, and an envelope accommodating the anode target, the anode target rotating mechanism and the cathode;

a stator coil configured to generate a driving force for rotating the anode target rotating mechanism;

a housing comprising an X-ray radiation port opening in a direction perpendicular to the axis, and storing and holding the X-ray tube and the stator coil;

an X-ray radiation window configured to close the X-ray radiation port and to take out the X-rays to an outside of the housing;

a coolant filled in a space between the X-ray tube and the housing and absorbing at least part of heat produced by the X-ray tube;

a conduit communicating with the housing and forming, together with the housing, a passage of the coolant; and a cooler unit attached to the conduit and comprising a circulating pump configured to circulate the coolant and a radiator configured to radiate heat of the coolant, wherein the housing includes a first divisional part which includes the X-ray radiation port and to which the X-ray tube is directly or indirectly fixed, and a second divisional part located on a side opposite to the anode target with respect to the anode target rotating mechanism and coupled to the first divisional part, and a coupling surface between the first divisional part and the second divisional part is located on one plane, and is inclined to the axis, with exclusion of a direction perpendicular to the axis.

11. The rotating-anode X-ray tube apparatus of claim 10, wherein the cooler unit further comprises a fan unit configured to produce a flow of air in a vicinity of the radiator.

12. A rotating-anode X-ray tube apparatus comprising:

an X-ray tube comprising an anode target including a target layer which emits X-rays, an anode target rotating mechanism configured to rotatably support the anode target, a cathode disposed opposite to the target layer in a direction along an axis of the anode target and configured to emit electrons, and an envelope accommodating the anode target, the anode target rotating mechanism and the cathode;

a stator coil configured to generate a driving force for rotating the anode target rotating mechanism;

a housing including an X-ray radiation port opening in a direction perpendicular to the axis, and storing and holding the X-ray tube and the stator coil;

an X-ray radiation window configured to close the X-ray radiation port and to take out the X-rays to an outside of the housing;

a coolant filled in a space between the X-ray tube and the housing and absorbing at least part of heat produced by the X-ray tube;

a conduit;

another coolant; and a cooler unit, wherein the housing includes a first divisional part which includes the X-ray radiation port and to which the X-ray tube is directly or indirectly fixed, and a second divisional part located on a side opposite to the anode target with respect to the anode target rotating mechanism and coupled to the first divisional part, a coupling surface between the first divisional part and the second divisional part is located on one plane, and is inclined to the axis, with exclusion of a direction perpendicular to the axis, the X-ray tube comprises a cooling passage configured to radiate at least part of heat produced, the conduit communicates with the cooling passage of the X-ray tube through the housing, the another coolant is filled in the cooling passage and the conduit, and absorbs at least part of heat produced by the X-ray tube, and the cooler unit is attached to the conduit and comprises a circulating pump configured to circulate the another coolant and a radiator configured to radiate heat of the another coolant.

13. The rotating-anode X-ray tube apparatus of claim 12, wherein the cooler unit further comprises a fan unit configured to produce a flow of air in a vicinity of the radiator.

* * * * *